US005744275A

United States Patent [19]

Duggan et al.

[11] Patent Number: 5,744,275

[45] Date of Patent: Apr. 28, 1998

[54] COATED CARRIER PARTICLES

[75] Inventors: Michael J. Duggan, Webster; Thomas C. Dombroski, Rochester; Scott M. Silence, Fairport, all of N.Y.

[73] Assignee: Xerox Corporation, Stamford, Conn.

[21] Appl. No.: 829,552

[22] Filed: Mar. 28, 1997

[51] Int. Cl.[6] ..... G03G 9/113

[52] U.S. Cl. ..... 430/108; 430/137

[58] Field of Search ..... 430/108, 137

[56] References Cited

U.S. PATENT DOCUMENTS

| | | | |
|---|---|---|---|
| 3,590,000 | 6/1971 | Palermiti et al. | 430/110 |
| 4,233,387 | 11/1980 | Mammino et al. | 430/137 |
| 4,374,192 | 2/1983 | Mayer et al. | 430/108 |
| 4,810,611 | 3/1989 | Ziolo et al | 430/106.6 |
| 4,935,326 | 6/1990 | Creatura et al. | 430/108 |
| 4,937,166 | 6/1990 | Creatura et al. | 430/108 |
| 5,332,638 | 7/1994 | Creatura et al. | 430/137 |
| 5,547,795 | 8/1996 | Ochiai et al. | 430/108 |

*Primary Examiner*—Ronald Martin
*Attorney, Agent, or Firm*—E. O. Palazzo

[57] ABSTRACT

A composition comprised of a core and thereover a mixture of a first and second polymer, and wherein said first polymer contains a conductive component, and said second polymer is a poly(urethane).

37 Claims, No Drawings

COATED CARRIER PARTICLES

BACKGROUND OF THE INVENTION

This invention is generally directed to developer compositions, and more specifically, the present invention relates to developer compositions with coated carrier particles that can be prepared by dry powder processes. In embodiments of the present invention, the carrier particles are comprised of a core with polymeric mixture coating thereover, and more specifically, a mixture of two polymers, and dispersed in one polymer conductive components, such as carbon black, and wherein one of the polymers is a thermosetting polymer of a poly(urethane), thereby enabling carriers with increased developer tribloelectric response at relative humidities of from about 20 to about 90 percent, improved image quality performance, excellent high conductivity ranges of from about $10^{-10}$ to about $10^{-7}$ (ohm-cm)$^{-1}$, and a carrier tribo range of from about a plus 5 to a plus 50 microcoulombs per gram, preferably from about a plus 15 to a plus 40 microcoulombs per gram, and most preferably from about a plus 25 to a plus 35 microcoulombs per gram. The carrier particles prepared in accordance with the processes of the present invention contain in certain important amounts a polyurethane, for example from about 0.05 to about 3 and preferably from about 0.1 to about 0.3 weight percent to enable in combination with the polymer/conductive coating a large carrier conductivity range, and a wide carrier triboelectric range, and wherein the carriers generated can be selected for a number of different xerographic copiers and printers wherein carriers with certain specific conductivity and certain tribo charge are required. Developer compositions comprised of the carrier particles illustrated herein and prepared, for example, by a dry coating process are useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected depending on the polymer composition and dispersant component applied to the carrier core and the type and amount of the conductive component selected.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith as it is these values that enable continued constant developed images of high quality and excellent resolution.

Additionally, carrier particles for use in the development of electrostatic latent images are described in many patents including, for example, U.S. Pat. No. 3,590,000. These carrier particles contain various cores, including steel, with a coating thereover of fluoropolymers, and terpolymers of styrene, methacrylate, and silane compounds. Past efforts have focused on the attainment of coatings for carrier particles for the purpose of improving development quality, and also to permit particles that can be recycled, and that do not adversely effect the imaging member in any substantial manner. A number of coatings can deteriorate rapidly, especially when selected for a continuous xerographic process where the entire coating may separate from the carrier core in the form of chips or flakes; and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There are illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent are suitable for their intended purposes, the conductivity values of the resulting particles are not constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, the conductivity of the resulting carrier particles can be substantially constant, and moreover, the triboelectric values can be selected to vary significantly, for example, from less than −30 microcoulombs per gram to +40 microcoulombs per gram.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by there is disclosed that there can be added to carrier coatings colorless conductive metal halides in an amount of from about 25 to about 75 weight percent, such halides including copper iodide, copper fluoride, and mixtures thereof.

With further reference to the prior art, carriers obtained by applying insulating resinous coatings to porous metallic carrier cores using solution coating techniques are undesirable from many viewpoints. For example, the coating material will usually reside in the pores of the carrier cores, rather than at the surfaces thereof; and therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome these disadvantages, and further enable developers that are capable of generating high and useful triboelectric charging values with finely divided toner particles; and also wherein the carrier particles are of substantially constant conductivity.

When resin coated carrier particles are prepared by the powder coating process of the present invention, the majority of the coating materials are fused to the carrier surface thereby reducing the number of toner impaction sites on the carrier material. Additionally, there can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations. Thus, for example, there can be formulated in accordance with the invention of the present application developers with conductivities of from about $10^{-6}$ (ohm-cm)$^{-1}$ to about $10^{-17}$ (ohm-cm)$^{-1}$, preferably from about $10^{-10}$ (ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$, determined in a magnetic brush conducting cell, and a wide carrier triboelectric charging value of from about +5 to about +50, and in embodiments of from about +10 to about +40 microcoulombs per gram on the carrier particles as determined by the known Faraday Cage technique. Thus, the developers of the present invention can be formulated with conductivity values in the preferred range with different triboelectric charging characteristics by, for example, maintaining the same total coating weight on the carrier particles and changing ratio of the amount of a first polymer which contains a conductive component and a second polymer.

Also known are carrier with a polymer coating of polymethylmethacrylate and contained therein conductive particles of carbon black.

The advantages of the carriers of the present invention compared to some of the aforementioned prior art carriers include a decreased sensitivity of the carrier triboelectric value to the relative humidity of the environment. For example, a carrier comprised of a steel core onto which is coated 1 percent by weight of a carbon black containing polymethylmethacrylate has a triboelectric value of 10.4 microcoulombs per gram as measured against a standard reference toner at an environmental relative humidity of 80 percent; the same carrier has a triboelectric value of 18.9 microcoulombs per gram at an environmental relative humidity of 20 percent, providing a triboelectric ratio of 1.8, that is the ratio of the triboelectric value at 20 percent relative humidity to that of 80 percent relative humidity. A carrier with a steel core onto which is coated 0.8 percent by weight of a carbon black containing polymethylmethacrylate and 0.2 percent by weight of a polyurethane polymer (Envirocron, obtained from PPG Inc.) has a triboelectric value of 18.4 microcoulombs per gram as measured against a standard reference toner at an environmental relative humidity of 80 percent and a triboelectric value of 22.6 microcoulombs per gram at an environmental relative humidity of 20 percent. This provides a substantially improved triboelectric ratio of 1.2.

Other U.S. patents that may be of interest include U.S. Pat. No. 3,939,086, which illustrates steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is an object of the present invention to provide toner and developer compositions with carrier particles containing polymer coatings.

In another object of the present invention there are provided dry coating processes for generating carrier particles of substantially constant conductivity parameters.

In yet another object of the present invention there are provided dry coating processes for generating carrier particles of substantially constant conductivity parameters, and a wide range of preselected triboelectric charging values.

In yet a further object of the present invention there are provided carrier particles with a coating of two polymers of polymethylmethacrylate and a thermosetting polymer of a poly(urethane), and wherein the first polymer of, for example, polymethylmethacrylate contains therein a conductive component o,f for example, carbon black.

In embodiments of the present invention, there are provided developer compositions comprised of toner particles, and carrier particles prepared by a powder coating process, and wherein the carrier particles are comprised of a core with certain coatings thereover. More specifically, the carrier particles selected can be prepared by mixing low density porous magnetic, or magnetically attractable metal core carrier particles with from, for example, between about 0.05 percent and about 3 percent by weight, based on the weight of the coated carrier particles, of a first polymer, especially polymethylmethacrylate, and which polymer has dispersed therein carbon black or a similar conductive component, and a second thermosetting polymer until adherence thereof to the carrier core by mechanical impaction or electrostatic attraction; heating the resulting mixture of carrier core particles and polymer to a temperature, for example, of between from about 200° F. to about 550° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter.

Embodiments of the present invention include a composition comprised of a core, and thereover a mixture of a first and second polymer, and wherein the first polymer contains a conductive component, and the second polymer is a thermosetting poly(urethane), such as Envirocron obtained from PPG Industries; a carrier composition wherein the polyurethane is present in an amount of from about 1 to about 99 weight percent, and preferably from about 5 to about 40 percent, based on the amount of the second polymer, and wherein the first polymer contains a conducting component; a carrier with two polymers thereover and wherein the conductive component for the first polymer is a metal oxide, or a pigment, like preferably carbon black, wherein the conductive component for said first polymer is carbon black selected in an amount of from about 15 to about 50 weight percent; wherein the second polymer is as illustrated herein, that is a thermosetting polymer, a polyester, or a styrene based polymer, and the first polymer is polymethylmethacrylate, wherein the first polymer is selected in an amount of from about 1 to about 99, or from about 5 to about 50 weight percent, and the second polymer is selected in an amount of from about 99 to about 1, or from about 5 to about 50 weight percent; or wherein the carrier core is a metal, a ferrite, a metal oxide, and the like such as known carrier cores.

Various suitable solid core carrier materials can be selected for the developers of the present invention. Characteristic core properties of importance include those that will enable the toner particles to acquire a positive charge or a negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics. Examples of carrier cores that can be selected include iron, steel, ferrites such as Sr (strontium)-ferrite, Ba-ferrite, Cu/Zn-ferrite, and Ni/Zn-ferrite, magnetites, nickel, mixtures thereof, and the like. Preferred carrier cores include ferrites, and sponge iron, or steel grit with an average particle size diameter of from between about 30 microns to about 200 microns.

The first polymer coating has dispersed therein conductive components, such as metal oxides like tin oxide, conductive carbon blacks, and the like, in effective amounts of, for example, from about 1 to about 70 and preferably from about 15 to about 60 weight percent. Specific examples of conductive components include the conductive carbon black SC Ultra available from Conductex, Inc., and antimony-doped tin oxide Zelec ECP3005-XC manufactured by DuPont.

The process for incorporating the polymers onto a carrier core can be sequential, a process in which one of the two polymers is fused to the surface in a first step and the second polymer is fused to the surface in a subsequent fusing step. Alternatively, the process for incorporation can comprise a single fusing step in which the two polymers, which are, for example, mixed with each other prior to the fusing process, are incorporated onto the core in a single fusing step.

Also, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, and the like, including those as specifically illustrated herein, and other effective known charge agents or additives. The charge additives are selected in various effective amounts, such as from about 0.05 to about 15 weight percent.

Examples of first polymers selected include polymethacrylate, fluorocarbon polymers, polyvinylidenefluoride, polyvinylfluoride, polypentafluorostyrene, polyethylene, polymethylmethacrylate, copolyethylenevinylacetate, copolyvinylidenefluoride tetrafluoroethylene, polyethylene, and the like. Other known related polymers not specifically mentioned herein may also be selected, such as those illustrated in the U.S. Pat. Nos. 4,937,166 and 4,935,326 patents mentioned herein.

The second polymer is comprised of a thermosetting polymer, more specifically a poly(urethane) thermosetting resin which contains, for example, about 20 percent by weight of a polyester polymer, which functions primarily as a crosslinking agent for the polyurethane. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. In embodiments, the polyurethane possesses a melt temperature of from about 200° F. to about 260° F., and a crosslinking temperature of from about 330° F. to about 420 ° F. This second polymer is mixed together with the first polymer, generally prior to mixing with the core, which when fused forms a uniform coating of the first and second polymers on the carrier surface. The second polymer is present in an amount of from about 1 percent to about 99 percent by weight, based on the total weight of the first and second polymers and the conductive component in the first polymer, and preferably from about 5 percent to about 40 percent.

The advantages of the carriers of the present invention include in embodiments a decreased sensitivity of the carrier triboelectric value to the is relative humidity of the environment. For example, a carrier with a steel core onto which is coated 1 percent by weight of a carbon black containing polymethylmethacrylate has a triboelectric value of 10.4 microcoulombs per gram as measured against a standard reference toner, such as the Xerox Corporation 5090 toner, at an environmental relative humidity of 80 percent; the same carrier has a triboelectric value of 18.9 microcoulombs per gram at an environmental relative humidity of 20 percent, providing a triboelectric ratio of 1.8, that is the ratio of the triboelectric value at 20 percent relative humidity to that of 80 percent relative humidity. A carrier with a steel core onto which is coated 0.8 percent by weight of a carbon black containing polymethylmethacrylate and 0.2 percent by weight of a polyurethane polymer (Envirocron, obtained from PPG Industries, Inc.) has a triboelectric value of 18.4 microcoulombs per gram as measured against a standard reference toner, such as the Xerox Corporation 5090 toner, at an environmental relative humidity of 80 percent and a triboelectric value of 22.6 microcoulombs per gram at an environmental relative humidity of 20 percent. This gives a substantially improved triboelectric ratio of 1.2.

Various effective suitable processes can be selected to apply the polymer, or mixture of polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-9}$ to about $10^{-17}$ mho-cm$^{-}$as measured, for example, across a 0.1 inch magnetic brush at an applied potential of 10 volts; and wherein the coating coverage encompasses from about 10 percent to about 100 percent of the carrier core.

Illustrative examples of toner resins selected for the toner, which when admixed with carrier generates developer compositions, include a number of thermoplastics, such as polyamides, epoxies, polyurethanes, diolefins, vinyl resins, polyesters, such as those obtained by the polymeric esterification products of a dicarboxylic acid and a diol comprising a diphenol. Specific vinyl monomers that can be used are styrene, p-chlorostyrene vinyl unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol.

Generally, from about 1 part to about 5 parts by weight of toner particles are mixed with from about 10 to about 300 parts by weight of the carrier particles.

Numerous well known suitable pigments or dyes, and preferably pigments can be selected as the colorant for the toner particles including, for example, carbon black, nigrosine dye, lamp black, iron oxides, magnetites, and mixtures thereof. The pigment, which is preferably carbon black, should present in a sufficient amount to render the toner composition highly colored. Thus, the pigment is present in amounts of from about 1 percent by weight to about 20, and preferably from about 5 to about 12 percent by weight, based on the total weight of the toner composition, however, lesser or greater amounts of pigment may be selected.

When the pigment particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant, such as carbon black like REGAL 330®, is contained therein, about 90 percent by weight of resin material is selected. Generally, however, the toner composition is comprised of from about 85 percent to about 97 percent by weight of toner resin particles, and from about 3 percent by weight to about 15 percent by weight of pigment particles such as carbon black.

Also, there may be selected colored toner compositions comprised of toner resin particles, carrier particles and as pigments or colorants, magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as CI 60720, CI Dispersed Red 15, a diazo dye identified in the Color Index as CI 26050, CI Solvent Red 19, and the like. Examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy4-sulfonanilide phenylazo-4'-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

For further enhancing the positive charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives. These additives are usually incorporated into the toner in an amount of from about 0.1 percent by weight to about 20 percent by weight. These charge additives can also be dispersed in the carrier polymer coating as indicated herein.

The toner composition of the present invention can be prepared by a number of known methods including melt blending the toner resin particles, and pigment particles or colorants of the present invention followed by mechanical attrition, emulsion/aggregation, and the like. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the '990 patent. These layered members are conventionally charged negatively thus requiring a positively charged toner.

Images obtained with this developer composition possess, for example, acceptable solids, excellent halftones, and desirable line resolution with acceptable or substantially no background deposits.

The following Examples are being supplied to further define the present invention, it being noted that these Examples are intended to illustrate and not limit the scope of the present invention. Parts and percentages are by weight unless otherwise indicated.

EXAMPLE I

In the following carrier coating process, 54.5 grams of polyurethane polymer (Envirocron by PPG Industries, Inc.) with a particle size of between 4 and 7 microns were mixed in a high intensity blender with 490.5 grams of carbon black-loaded poly(methylmethacrylate) with about 20 weight percent of Conductex SC Ultra conductive carbon black produced with a volume median particle size of 2 microns in a chemical process prior to mixing. These 545 grams of premixed polymer were mixed with 68.0 kilograms of 90 micron atomized steel shot (Hoeganaes, Inc.). The mixing was accomplished in a Munson Minimixer blender with the following process conditions: blender speed of 17 rotations per minute, a blend time of 20 minutes, and a humidity of 3 millimeters Hg. There resulted uniformly distributed and electrostatically attached, as determined by visual observation, on the carrier core the premixed polymers. Thereafter, the resulting carrier particles were inserted into a rotating tube furnace for a period of 35 minutes. This furnace was maintained at a temperature of 380° F. thereby causing the polymers to melt and fuse to the core.

The final product was comprised of a carrier core with a total of 0.8 percent polymer mixture by weight on the surface with the polymer being a combination of 10 percent by weight of the polyurethane and 90 percent by weight of the carbon black-loaded poly(methylmethacrylate).

A developer composition was then prepared by mixing 194 grams of the above prepared carrier with 6 grams of a toner composition comprised of 87 percent by weight of a 30 percent (by weight) gel content partially crosslinked polyester resin, reference U.S. Pat. No. 5,376,494, the disclosure of which is totally incorporated herein by reference, obtained by the reactive extrusion of a linear polyester, 5 percent by weight of carbon black, 4 percent by weight of a polypropylene wax, 660P low molecular weight wax available from Sanyo Chemicals, and 4 percent by weight of a compatibilizing agent comprised of the grafted copolymer KRATON™ obtained from Shell Chemicals.

Thereafter, the triboelectric charge on the carrier particles was determined by the known Faraday Cage process after churning/mixing on a magnetic roll for 60 minutes in an 80° F./80 percent relative humidity environment and a 70° F./20 percent relative humidity environment. There was measured on the carrier a charge of 14.6 microcoulombs per gram in the 80° F./80 percent relative humidity environment, and a charge of 22.6 microcoulombs per gram in the 70° F./20 percent relative humidity environment. Further, the conductivity of the carrier as determined by forming a 0.1 inch long magnetic brush of the carrier particles, and measuring the conductivity by imposing a 10 volt potential across the brush was $1.9\times10^{-7}$ mho-cm$^{-1}$. Therefore, these carrier particles were conducting.

In all the Examples, the triboelectric charging values and the conductivity numbers were obtained in accordance with the aforementioned procedure.

EXAMPLE II

The process of Example I was repeated, except that 1.0 percent by weight of the carrier was comprised of the polymer mixture and it was mixed in the Munson at 27 revolutions per minute for 30 minutes with a humidity of 7 millimeters Hg. Thereafter, the resulting carrier particles were inserted into a rotating tube furnace for a period of 35 minutes. This furnace was maintained at a temperature of 400° F. thereby causing the polymers to melt and fuse to the core. The final product was comprised of a carrier core with a total of 1.0 percent polymer mixture by weight on the surface with the polymer mixture being a combination of 10 percent by weight of the polyurethane and 90 percent by weight of the carbon black-loaded poly (methylmethacrylate).

A developer composition was then prepared and characterized as described in Example I. There was measured on the carrier a charge of 15.7 microcoulombs per gram in the 80° F./80 percent relative humidity environment, and a charge of 22.2 microcoulombs per gram in the 70° F./20 percent relative humidity environment. Further, the conductivity of the carrier was $6.7\times10^{-8}$ mho-cm$^{-1}$. Therefore, these carrier particles were conducting.

EXAMPLE III

The process of Example I was repeated, except that 1.2 percent by weight of the carrier was comprised of the polymer mixture and it was mixed in the Munson at 37 revolutions per minute for 40 minutes with a humidity of 12 millimeters Hg. Thereafter, the resulting carrier particles were inserted into a rotating tube furnace for a period of 35 minutes. This furnace was maintained at a temperature of 420° F. thereby causing the polymers to melt and fuse to the core. The final product was comprised of a carrier core with a total of 1.2 percent polymer mixture by weight on the surface with the polymer mixture being a combination of 10 percent by weight of the polyurethane and 90 percent by weight of the carbon black-loaded poly (methylmethacrylate).

A developer composition was then prepared and characterized as described in Example I. There was measured on the carrier a charge of 13.4 microcoulombs per gram in the 80° F./80 percent relative humidity environment, and a charge of 19.3 microcoulombs per gram in the 70° F./20 percent relative humidity environment. Further, the conductivity of the carrier was $3.7\times10^{-8}$ mho-cm$^{-1}$. Therefore, these carrier particles were conducting.

EXAMPLE IV

The process of Example I was repeated, except that 1.2 percent by weight of the carrier was comprised of the polymer mixture and it was mixed in the Munson at 37 revolutions per minute for 30 minutes with a humidity of 7 millimeters Hg. Thereafter, the resulting carrier particles were inserted into a rotating tube furnace for a period of 32 minutes. This furnace was maintained at a temperature of 380° F. thereby causing the polymers to melt and fuse to the core. The final product was comprised of a carrier core with a total of 1.2 percent polymer mixture by weight on the surface with the polymer mixture being a combination of 15 percent by weight of the polyurethane and 85 percent by weight of the carbon black-loaded poly (methylmethacrylate).

A developer composition was then prepared and characterized as described in Example I. There was measured on the carrier a charge of 18.7 microcoulombs per gram in the 80° F./80 percent relative humidity environment, and a charge of 25.4 microcoulombs per gram in the 70° F./20 percent relative humidity environment. Further, the conductivity of the carrier was $4.7\times10^{-8}$ mho-cm$^{-1}$. Therefore, these carrier particles were conducting.

EXAMPLE V

The process of Example I was repeated, except that 0.8 percent by weight of the carrier was comprised of the polymer mixture and it was mixed in the Munson at 17 revolutions per minute for 40 minutes with a humidity of 12 millimeters Hg. Thereafter, the resulting carrier particles were inserted into a rotating tube furnace for a period of 34 minutes. This furnace was maintained at a temperature of 400° F. thereby causing the polymers to melt and fuse to the core. The final product was comprised of a carrier core with a total of 0.8 percent polymer mixture by weight on the surface with the polymer mixture being a combination of 15 percent by weight of the polyurethane and 85 percent by weight of the carbon black-loaded poly (methylmethacrylate).

A developer composition was then prepared by repeating the process of Example I, and the developer was characterized as described in Example I. There was measured on the carrier a charge of 16.2 microcoulombs per gram in the 80° F./80 percent relative humidity environment, and a charge of 21.5 microcoulombs per gram in the 70° F./20 percent relative humidity environment. Further, the conductivity of the carrier was $8.1\times10^{-8}$ mho-cm$^{-1}$. Therefore, these carrier particles were conducting.

EXAMPLE VI

The process of Example I was repeated, except that 1.0 percent by weight of the carrier was comprised of the polymer mixture and it was mixed in the Munson at 27 revolutions per minute for 20 minutes with a humidity of 3 millimeters Hg. Thereafter, the resulting carrier particles were inserted into a rotating tube furnace for a period of 37 minutes. This furnace was maintained at a temperature of 420° F. thereby causing the polymers to melt and fuse to the core. The final product was comprised of a carrier core with a total of 1.0 percent polymer mixture by weight on the surface with the polymer mixture being a combination of 15 percent by weight of the polyurethane and 85 percent by weight of the carbon black-loaded poly (methylmethacrylate).

A developer composition was then prepared and characterized as described in Example I. There was measured on the carrier a charge of 15.9 microcoulombs per gram in the 80° F./80 percent relative humidity environment, and a charge of 21.9 microcoulombs per gram in the 70° F./20 percent relative humidity environment. Further, the conductivity of the carrier was $2.3\times10^{-8}$ mho-cm$^{-1}$. Therefore, these carrier particles were conducting.

EXAMPLE VII

The process of Example I was repeated, except that 1.0 percent by weight of the carrier was comprised of the polymer mixture and it was mixed in the Munson at 37 revolutions per minute for 40 minutes with a humidity of 3 millimeters Hg. Thereafter, the resulting carrier particles were inserted into a rotating tube furnace for a period of 32 minutes. This furnace was maintained at a temperature of 380° F. thereby causing the polymers to melt and fuse to the core. The final product was comprised of a carrier core with a total of 1.0 percent polymer mixture by weight on the surface with the polymer mixture being a combination of 20 percent by weight of the polyurethane and 80 percent by weight of the carbon black-loaded poly (methylmethacrylate).

A developer composition was then prepared and characterized as illustrated in Example I. There was measured on the carrier a charge of 18.4 microcoulombs per gram in the 80° F./80 percent relative humidity environment, and a charge of 25.9 microcoulombs per gram in the 70° F./20 percent relative humidity environment. Further, the conductivity of the carrier was $2.6\times10^{-8}$ mho-cm$^{-1}$. Therefore, these carrier particles were conducting.

EXAMPLE VIII

The process of Example I was repeated, except that 1.2 percent by weight of the carrier was comprised of the polymer mixture and it was mixed in the Munson at 17 revolutions per minute for 20 minutes with a humidity of 7 millimeters Hg. Thereafter, the resulting carrier particles were inserted into a rotating tube furnace for a period of 34 minutes. This furnace was maintained at a temperature of 400° F. thereby causing the polymers to melt and fuse to the core. The final product was comprised of a carrier core with a total of 1.2 percent polymer mixture by weight on the surface with the polymer mixture being a combination of 20 percent by weight of the polyurethane and 80 percent by weight of the carbon black-loaded poly (methylmethacrylate).

A developer composition was then prepared and characterized as described in Example I. There was measured on the carrier a charge of 21.5 microcoulombs per gram in the 80° F./80 percent relative humidity environment, and a charge of 28.2 microcoulombs per gram in the 70° F./20 percent relative humidity environment. Further, the conductivity of the carrier was $2.3\times10^{-8}$. Therefore, these carrier particles were conducting.

EXAMPLE IX

The process of Example I was repeated, except that 0.8 percent by weight of the carrier was comprised of the polymer mixture and it was mixed in the Munson at 27 revolutions per minute for 30 minutes with a humidity of 12 millimeters Hg. Thereafter, the resulting carrier particles were inserted into a rotating tube furnace for a period of 35 minutes. This furnace was maintained at a temperature of 420° F. thereby causing the polymers to melt and fuse to the core. The final product was comprised of a carrier core with a total of 0.8 percent polymer mixture by weight on the surface with the polymer mixture being a combination of 20 percent by weight of the polyurethane and 80 percent by weight of the carbon black-loaded poly (methylmethacrylate).

A developer composition was then prepared and characterized as described in Example I. There was measured on the carrier a charge of 15.3 microcoulombs per gram in the 80° F./80 percent relative humidity environment, and a charge of 24.3 microcoulombs per gram in the 70° F./20 percent relative humidity environment. Further, the conductivity of the carrier was $1.4\times10^{-8}$ mho-cm$^{-1}$. Therefore, these carrier particles were conducting.

EXAMPLE X

The process of Example I was repeated, except that 1.0 percent by weight of the carrier was comprised of the polymer mixture and it was mixed in the Munson at 17 revolutions per minute for 30 minutes with a humidity of 12 millimeters Hg. Thereafter, the resulting carrier particles were inserted into a rotating tube furnace for a period of 33 minutes. This furnace was maintained at a temperature of 380° F. thereby causing the polymers to melt and fuse to the core. The final product was comprised of a carrier core with a total of 1.0 percent polymer mixture by weight on the surface with the polymer mixture being a combination of 25 percent by weight of the polyurethane and 75 percent by weight of the carbon black-loaded poly (methylmethacrylate).

A developer composition was then prepared and characterized as described in Example I. There was measured on the carrier a charge of 23.0 microcoulombs per gram in the 80° F./80 percent relative humidity environment, and a charge of 30.5 microcoulombs per gram in the 70° F./20 percent relative humidity environment. Further, the conductivity of the carrier was $1.1\times10^{-8}$ mho-cm$^{-1}$. Therefore, the carrier particles were conducting.

EXAMPLE XI

The process of Example I was repeated, except that 1.2 percent by weight of the carrier was comprised of the polymer mixture and it was mixed in the Munson at 27 revolutions per minute for 40 minutes with a humidity of 3 millimeters Hg. Thereafter, the resulting carrier particles were inserted into a rotating tube furnace for a period of 36 minutes. This furnace was maintained at a temperature of 400° F. thereby causing the polymers to melt and fuse to the core. The final product was comprised of a carrier core with a total of 1.2 percent polymer mixture by weight on the surface with the polymer mixture being a combination of 25 percent by weight of the polyurethane and 75 percent by weight of the carbon black-loaded poly (methylmethacrylate).

A developer composition was then prepared and characterized as described in Example I. There was measured on the carrier a charge of 19.1 microcoulombs per gram in the 80° F./80 percent relative humidity environment, and a charge of 26.0 microcoulombs per gram in the 70° F./20 percent relative humidity environment. Further, the conductivity of the carrier was $3.8\times10^{-9}$ mho-cm$^{-1}$. Therefore, these carrier particles were semiconducting.

EXAMPLE XII

The process of Example I was repeated, except that 0.8 percent by weight of the carrier was comprised of the polymer mixture and it was mixed in the Munson at 37 revolutions per minute for 20 minutes with a humidity of 7 millimeters Hg. Thereafter, the resulting carrier particles were inserted into a rotating tube furnace for a period of 33 minutes. This furnace was maintained at a temperature of 420° F. thereby causing the polymers to melt and fuse to the core. The final product was comprised of a carrier core with a total of 0.8 percent polymer mixture by weight on the surface with the polymer mixture being a combination of 25 percent by weight of the polyurethane and 75 percent by weight of the carbon black-loaded poly (methylmethacrylate).

A developer composition was then prepared and characterized as described in Example I. There was measured on the carrier a charge of 16.4 microcoulombs per gram in the 80° F./80 percent relative humidity environment, and a charge of 21.7 microcoulombs per gram in the 70° F./20 percent relative humidity environment. Further, the conductivity of the carrier was $8.1\times10^{-9}$ mho-cm$^{-1}$. Therefore, these carrier particles were semiconducting.

EXAMPLE XIII

The process of Example I was repeated, except that 1.2 percent by weight of the carrier was comprised of the polymer mixture and it was mixed in the Munson at 27 revolutions per minute for 20 minutes with a humidity of 12 millimeters Hg. Thereafter, the resulting carrier particles were inserted into a rotating tube furnace for a period of 31 minutes. This furnace was maintained at a temperature of 380° F. thereby causing the polymers to melt and fuse to the core. The final product was comprised of a carrier core with a total of 1.2 percent polymer mixture by weight on the surface with the polymer mixture being a combination of 30 percent by weight of the polyurethane and 70 percent by weight of the carbon black-loaded poly (methylmethacrylate).

A developer composition was then prepared and characterized as described in Example I. There was measured on the carrier a charge of 24.8 microcoulombs per gram in the 80° F./80 percent relative humidity environment, and a charge of 31.7 microcoulombs per gram in the 70° F./20 percent relative humidity environment. Further, the conductivity of the carrier was $3.9\times10^{-9}$ mho-cm$^{-1}$. Therefore, these carrier particles were semiconducting.

EXAMPLE XIV

The process of Example I was repeated, except that 0.8 percent by weight of the carrier was comprised of the polymer mixture and it was mixed in the Munson at 37 revolutions per minute for 30 minutes with a humidity of 3 millimeters Hg. Thereafter, the resulting carrier particles were inserted into a rotating tube furnace for a period of 36 minutes. This furnace was maintained at a temperature of 400° F. thereby causing the polymers to melt and fuse to the core. The final product was comprised of a carrier core with a total of 0.8 percent polymer mixture by weight on the surface with the polymer mixture being a combination of 30 percent by weight of the polyurethane and 70 percent by weight of the carbon black-loaded poly (methylmethacrylate).

A developer composition was then prepared and characterized as described in Example I. There was measured on the carrier a charge of 20.0 microcoulombs per gram in the 80° F./80 percent relative humidity environment, and a charge of 25.6 microcoulombs per gram in the 70° F./20 percent relative humidity environment. Further, the conductivity of the carrier was $6.4\times10^{-11}$ mho-cm$^{-1}$. Therefore, these carrier particles were semiconducting.

EXAMPLE XV

The process of Example I was repeated, except that 1.0 percent by weight of the carrier was comprised of the polymer mixture and it was mixed in the Munson at 17 revolutions per minute for 40 minutes with a humidity of 7 millimeters Hg. Thereafter, the resulting carrier particles were inserted into a rotating tube furnace for a period of 35 minutes. This furnace was maintained at a temperature of 420 F. thereby causing the polymers to melt and fuse to the core. The final product was comprised of a carrier core with a total of 1.0 percent polymer mixture by weight on the surface with the polymer mixture being a combination of 30 percent by weight of the polyurethane and 70 percent by weight of the carbon black-loaded poly (methylmethacrylate).

A developer composition was then prepared and characterized as described in Example I. There was measured on the carrier a charge of 17.1 microcoulombs per gram in the 80° F./80 percent relative humidity environment, and a charge of 24.5 microcoulombs per gram in the 70° F./20 percent relative humidity environment. Further, the conductivity of the carrier was $9.6\times10^{-10}$ mho-cm$^{-1}$. Therefore, these carrier particles were semiconducting.

EXAMPLE XVI

The process of Example I was repeated, except that 0.8 percent by weight of the carrier was comprised of the polymer mixture and it was mixed in the Munson at 27 revolutions per minute for 40 minutes with a humidity of 7 millimeters Hg. Thereafter, the resulting carrier particles were inserted into a rotating tube furnace for a period of 34 minutes. This furnace was maintained at a temperature of 380° F. thereby causing the polymers to melt and fuse to the core. The final product was comprised of a carrier core with a total of 0.8 percent polymer mixture by weight on the surface with the polymer mixture being a combination of 35 percent by weight of the polyurethane and 65 percent by weight of the carbon black-loaded poly (methylmethacrylate).

A developer composition was then prepared and characterized as described in Example I. There was measured on the carrier a charge of 21.2 microcoulombs per gram in the 80° F./80 percent relative humidity environment, and a charge of 31.9 microcoulombs per gram in the 70° F./20 percent relative humidity environment. Further, the conductivity of the carrier was $4.0\times10^{-11}$ mho-cm$^{-1}$. Therefore, these carrier particles were semiconducting.

EXAMPLE XVII

The process of Example I was repeated, except that 1.0 percent by weight of the carrier was comprised of the polymer mixture and it was mixed in the Munson at 37 revolutions per minute for 20 minutes with a humidity of 12 millimeters Hg. Thereafter, the resulting carrier particles were inserted into a rotating tube furnace for a period of 35 minutes. This furnace was maintained at a temperature of 400° F. thereby causing the polymers to melt and fuse to the core. The final product was comprised of a carrier core with a total of 1.0 percent polymer mixture by weight on the surface with the polymer mixture being a combination of 35 percent by weight of the polyurethane and 65 percent by weight of the carbon black-loaded poly (methylmethacrylate).

A developer composition was then prepared and characterized as described in Example I. There was measured on the carrier a charge of 20.6 microcoulombs per gram in the 80° F./80 percent relative humidity environment, and a charge of 28.8 microcoulombs per gram in the 70° F./20 percent relative humidity environment. Further, the conductivity of the carrier was $1.8\times10^{-11}$ mho-cm-$^{-1}$. Therefore, these carrier particles were insulating.

EXAMPLE XVIII

The process of Example I was repeated, except that 1.2 percent by weight of the carrier was comprised of the polymer mixture and it was mixed in the Munson at 17 revolutions per minute for 30 minutes with a humidity of 3 millimeters Hg. Thereafter, the resulting carrier particles were inserted into a rotating tube furnace for a period of 35 minutes. This furnace was maintained at a temperature of 420° F. thereby causing the polymers to melt and fuse to the core. The final product was comprised of a carrier core with a total of 1.2 percent polymer mixture by weight on the surface with the polymer mixture being a combination of 35 percent by weight of the polyurethane and 65 percent by weight of the carbon black-loaded poly (methylmethacrylate).

A developer composition was then prepared and characterized as described in Example I. There was measured on the carrier a charge of 21.9 microcoulombs per gram in the 80° F./80 percent relative humidity environment, and a charge of 26.9 microcoulombs per gram in the 70° F./20 percent relative humidity environment. Further, the conductivity of the carrier was $9.2\times10^{-12}$ mho-cm$^{-1}$. Therefore, these carrier particles were insulating.

EXAMPLE XIX

The process of Example I was repeated, except that 1.0 percent by weight of the carrier was comprised of the polymer mixture and it was mixed in the Munson at 27 revolutions per minute for 30 minutes with a humidity of 7 millimeters Hg. Thereafter, the resulting carrier particles were inserted into a rotating tube furnace for a period of 41 minutes. This furnace was maintained at a temperature of 380° F. thereby causing the polymers to melt and fuse to the core. The final product was comprised of a carrier core with a total of 1.0 percent polymer mixture by weight on the surface with the polymer mixture being a combination of 25 percent by weight of the polyurethane and 75 percent by weight of the carbon black-loaded poly (methylmethacrylate).

A developer composition was then prepared and characterized as described in Example I. There was measured on the carrier a charge of 20.7 microcoulombs per gram in the 80° F./80 percent relative humidity environment, and a charge of 26.7 microcoulombs per gram in the 70° F./20 percent relative humidity environment. Further, the conductivity of the carrier was $1.1\times10^{-9}$ mho-cm$^{-1}$. Therefore, these carrier particles were semiconductive.

EXAMPLE XX

The process of Example I was repeated, except that 1.0 percent by weight of the carrier was comprised of the polymer mixture and it was mixed in the Munson at 27 revolutions per minute for 30 minutes with a humidity of 7 millimeters Hg. Thereafter, the resulting carrier particles were inserted into a rotating tube furnace for a period of 42 minutes. This furnace was maintained at a temperature of 360° F. thereby causing the polymers to melt and fuse to the core. The final product was comprised of a carrier core with a total of 1.0 percent polymer mixture by weight on the surface with the polymer mixture being a combination of 20 percent by weight of the polyurethane and 80 percent by weight of the carbon black-loaded poly (methylmethacrylate).

A developer composition was then prepared and characterized as described in Example I. There was measured on the carrier a charge of 21.1 microcoulombs per gram in the 80° F./80 percent relative humidity environment, and a charge of 24.5 microcoulombs per gram in the 70° F./20 percent relative humidity environment. Further, the conductivity of the carrier was $1.5\times10^{-7}$ mho-cm$^{-1}$. Therefore, these carrier particles were conductive.

EXAMPLE XXI

The process of Example I was repeated, except that 1.0 percent by weight of the carrier was comprised of the polymer mixture and it was mixed in the Munson at 27 revolutions per minute for 30 minutes with a humidity of 7 millimeters Hg. Thereafter, the resulting carrier particles were inserted into a rotating tube furnace for a period of 27 minutes. This furnace was maintained at a temperature of 420° F. thereby causing the polymers to melt and fuse to the core. The final product was comprised of a carrier core with a total of 1.0 percent polymer mixture by weight on the surface with the polymer mixture being a combination of 20 percent by weight of the polyurethane and 80 percent by weight of the carbon black-loaded poly (methylmethacrylate).

A developer composition was then prepared and characterized as described in Example I. There was measured on the carrier a charge of 15.7 microcoulombs per gram in the 80° F./80 percent relative humidity environment, and a charge of 20.7 microcoulombs per gram in the 70° F./20 percent relative humidity environment. Further, the conductivity of the carrier was $1.4\times10^{-7}$ mho-cm$^{-1}$. Therefore, these carrier particles were conductive.

EXAMPLE XXII

The process of Example I was repeated, except that 1.0 percent by weight of the carrier was comprised of the polymer mixture and it was mixed in the Munson at 27 revolutions per minute for 30 minutes with a humidity of 7 millimeters Hg. Thereafter, the resulting carrier particles were inserted into a rotating tube furnace for a period of 44 minutes. This furnace was maintained at a temperature of 420° F. thereby causing the polymers to melt and fuse to the core. The final product was comprised of a carrier core with a total of 1.0 percent polymer mixture by weight on the surface with the polymer mixture being a combination of 80 percent by weight of the polyurethane and 20 percent by weight of the carbon black-loaded poly (methylmethacrylate).

A developer composition was then prepared and characterized as described in Example I. There was measured on the carrier a charge of 25.3 microcoulombs per gram in the 80° F./80 percent relative humidity environment, and a charge of 30.7 microcoulombs per gram in the 70° F./20 percent relative humidity environment. Further, the conductivity of the carrier was $2.1\times10^{-11}$ mho-cm$^{-1}$. Therefore, these carrier particles were insulative.

EXAMPLE XXIII

The process of Example I was repeated, except that 1.0 percent by weight of the carrier was comprised of the polymer mixture and it was mixed in the Munson at 27 revolutions per minute for 30 minutes with a humidity of 7 millimeters Hg. Thereafter, the resulting carrier particles were inserted into a rotating tube furnace for a period of 28 minutes. This furnace was maintained at a temperature of 360° F. thereby causing the polymers to melt and fuse to the core. The final product was comprised of a carrier core with a total of 1.0 percent polymer mixture by weight on the surface with the polymer mixture being a combination of 80 percent by weight of the polyurethane and 20 percent by weight of the carbon black-loaded poly (methylmethacrylate).

A developer composition was then prepared and characterized as described in Example I. There was measured on the carrier a charge of 26.3 microcoulombs per gram in the 80° F./80 percent relative humidity environment, and a charge of 31.2 microcoulombs per gram in the 70° F./20 percent relative humidity environment. Further, the conductivity of the carrier was $3.0\times10^{-11}$ mho-cm$^{-1}$. Therefore, these carrier particles were insulative.

EXAMPLE XXIV

The process of Example I was repeated, except that 1.0 percent by weight of the carrier was comprised of the polymer mixture and it was mixed in the Munson at 27 revolutions per minute for 30 minutes with a humidity of 7 millimeters Hg. Thereafter, the resulting carrier particles were inserted into a rotating tube furnace for a period of 28 minutes. This furnace was maintained at a temperature of 380° F. thereby causing the polymers to melt and fuse to the core. The final product was comprised of a carrier core with a total of 1.0 percent polymer mixture by weight on the surface with the polymer mixture being a combination of 40 percent by weight of the polyurethane and 60 percent by weight of the carbon black-loaded poly (methylmethacrylate).

A developer composition was then prepared as described in Example I. Thereafter, the triboelectric charge on the carrier particles was determined by the known Faraday Cage process, and there was measured on the carrier a charge of 33.7 microcoulombs per gram in the 70° F./50 percent relative humidity environment. Further, the conductivity of the carrier was $1.3\times10^{-11}$ mho-cm$^{-1}$. Therefore, these carrier particles were insulative.

EXAMPLE XXV

The process of Example I was repeated, except that 1.0 percent by weight of the carrier was comprised of the polymer mixture and it was mixed in the Munson at 27 revolutions per minute for 30 minutes with a humidity of 7 millimeters Hg. Thereafter, the resulting carrier particles were inserted into a rotating tube furnace for a period of 42 minutes. This furnace was maintained at a temperature of 400° F. thereby causing the polymers to melt and fuse to the core. The final product was comprised of a carrier core with a total of 1.0 percent polymer mixture by weight on the surface with the polymer mixture being a combination of 40 percent by weight of the polyurethane and 60 percent by weight of the carbon black loaded poly (methylmethacrylate).

A developer composition was then prepared as described in Example I. Thereafter, the triboelectric charge on the carrier particles was determined by the known Faraday Cage process, and there was measured on the carrier a charge of 34 microcoulombs per gram in the 70° F./50 percent relative humidity environment. Further, the conductivity of the carrier was $2.0\times10^{-11}$ mho-cm-$^{-1}$. Therefore, these carrier particles were insulative.

EXAMPLE XXVI

The process of Example I was repeated, except that 1.0 percent by weight of the carrier was comprised of the polymer mixture and it was mixed in the Munson at 27 revolutions per minute for 30 minutes with a humidity of 7 millimeters Hg. Thereafter, the resulting carrier particles were inserted into a rotating tube furnace for a period of 35 minutes. This furnace was maintained at a temperature of 400° F. thereby causing the polymers to melt and fuse to the core. The final product was comprised of a carrier core with a total of 1.0 percent polymer mixture by weight on the surface with the polymer mixture being a combination of 60 percent by weight of the polyurethane and 40 percent by weight of the carbon black-loaded poly (methylmethacrylate).

A developer composition was then prepared as described in Example I. Thereafter, the triboelectric charge on the carrier particles was determined by the known Faraday Cage process, and there was measured on the carrier a charge of 33.5 microcoulombs per gram in the 70° F./50 percent relative humidity environment. Further, the conductivity of the carrier was $1.0\times10^{-11}$ mho-cm$^{-1}$. Therefore, these carrier particles were insulative.

EXAMPLE XXVII

The process of Example I was repeated, except that 1.0 percent by weight of the carrier was comprised of the polymer mixture and it was mixed in the Munson at 27 revolutions per minute for 30 minutes with a humidity of 7 millimeters Hg. Thereafter, the resulting carrier particles were inserted into a rotating tube furnace for a period of 43 minutes. This furnace was maintained at a temperature of 380° F. thereby causing the polymers to melt and fuse to the core. The final product was comprised of a carrier core with a total of 1.0 percent polymer mixture by weight on the surface with the polymer mixture being a combination of 60 percent by weight of the polyurethane and 40 percent by weight of the carbon black-loaded poly (methylmethacrylate).

A developer composition was then prepared as described in Example I. Thereafter, the triboelectric charge on the carrier particles was determined by the known Faraday Cage process, and there was measured on the carrier a charge of 35.5 microcoulombs per gram in the 70° F./50 percent relative humidity environment. Further, the conductivity of the carrier was $1.6\times10^{-11}$ mho-cm$^{-1}$. Therefore, these carrier particles were insulative.

EXAMPLE XXVIII

The process of Example I was repeated, but without premixing the two polymers. Instead the polymers were added directly to the Munson mixer with the core. This mixture was mixed in the Munson at 27 revolutions per minute for 60 minutes with a humidity of 7 millimeters Hg. Thereafter, the resulting carrier particles were inserted into a rotating tube furnace for a period of 41 minutes. This furnace was maintained at a temperature of 380° F. thereby causing the polymers to melt and fuse to the core. The final product was comprised of a carrier core with a total of 1.0 percent polymer mixture by weight on the surface with the polymer mixture being a combination of 25 percent by weight of the polyurethane and 75 percent by weight of the carbon black-loaded poly(methylmethacrylate).

A developer composition was then prepared as described in Example I. Thereafter, the triboelectric charge on the carrier particles was determined by the known Faraday Cage process, and there was measured on the carrier a charge of 23.0 microcoulombs per gram in the 70° F./50 percent relative humidity environment. Further, the conductivity of the carrier was $7.4\times10^{-9}$ mho-cm$^{-1}$. Therefore, these carrier particles were semiconductive.

The toner carbon black selected for the above Examples was, unless otherwise indicated, REGAL 330®; the polypropylene was of a low molecular weight, about 7,000 it is believed, and was obtained from Sanyo Chemicals of Japan, or VISCOL 660P®; and the KRATON™ compatibilizer was a styrene-ethylene-butylene styrene block copolymer (Shell KRATON G 1726X®), reference U.S. Pat. No. 5,229,242, the disclosure of which is totally incorporated herein by reference.

Other embodiments and modifications of the present invention may occur to those of ordinary skill in the art subsequent to a review of the present application and the information presented herein; these embodiments and modifications, as well as equivalents thereof, are also included within the scope of the present invention.

What is claimed is:

1. A composition comprised of a core and thereover a mixture of a first and second polymer, and wherein said first polymer contains a conductive component, and said second polymer is a crosslinked poly(urethane).

2. A composition in accordance with claim 1 wherein the poly(urethane) possesses a melt temperature of from about 200° to 260° F., and a crosslinking temperature of from about 330° to about 420° F.

3. A composition in accordance with claim 2 wherein said conductive component for said first polymer is a metal oxide.

4. A composition in accordance with claim 2 wherein said conductive component for said first polymer is carbon black.

5. A composition in accordance with claim 2 wherein said conductive component for said first polymer is carbon black selected in an amount of from about 10 to about 60 weight percent.

6. A composition in accordance with claim 2 wherein said first polymer is polymethylmethacrylate.

7. A composition in accordance with claim 2 wherein said first polymer is selected in an amount of from about 1 to about 99 weight percent, and said second poly(urethane) polymer is selected in an amount of from about 99 to about 1 weight percent.

8. A composition in accordance with claim 1 wherein said core is a metal.

9. A composition in accordance with claim 1 wherein said core is a ferrite.

10. A composition in accordance with claim 1 wherein said core is a metal oxide.

11. A composition in accordance with claim 2 wherein said crosslinking temperature is from about 340° to about 380° F., and said carbon black is present in an amount of from about 15 to about 30 weight percent.

12. A composition in accordance with claim 2 wherein said carbon black is present in an amount of from about 17 to about 25 weight percent.

13. A composition in accordance with claim 1 wherein said compositions are carrier particles.

14. A process for the preparation of carrier which comprises (1) mixing carrier core with a mixture of a first and second polymer, and wherein said first polymer contains a conductive component, and said second polymer is a crosslinked poly(urethane); (2) dry mixing the resulting carrier core for a sufficient period of time to enable the polymers to adhere to the carrier core; (3) subsequently heating the mixture of carrier core particles and polymers to a temperature of between about 200° F. and about 550° F., whereby the polymers melt and fuse to the carrier core; and (4) thereafter cooling the resulting coated carrier particles.

15. A process in accordance with claim 14 wherein the poly(urethane) polymer is crosslinked, and is comprised of a combination of a polyester resin and a blocked polyisocyanate resin, wherein the polyester resin contains a blocked caprolactam functionality and the blocked polyisocyanate resin contains 5-isocyanato-1-(isocyanatomethyl)-1,3,3trimethyl-cyclohexane.

16. A process in accordance with claim 14 wherein the poly(urethane) possesses a melt temperature of greater than about 200° F. and a crosslinking temperature of greater than about 330° F.

17. A process in accordance with claim 14 wherein the conductive component is a conductive carbon black.

18. A process in accordance with claim 14 wherein the conductive component is carbon black present in an amount of from about 15 to about 60 weight percent.

19. A process in accordance with claim 14 wherein the carbon black is present in an amount of from about 15 to about 40 weight percent.

20. A process in accordance with claim 14 wherein the conductive component is carbon black present in an amount of from about 16 to about 20 weight percent.

21. A process in accordance with claim 14 wherein the conductive component is a conductive carbon black present in an amount of from about 15 to about 50 weight percent, the carrier conductivity is from about $10^{-6}$ to about $10^{-15}$ $(\text{ohm-cm})^{-1}$, and the carrier triboelectric charge is from about a positive 5 to about a positive 50 microcoulombs per gram.

22. A process in accordance with claim 14 wherein the conductive component is a conductive carbon black present in an amount of from about 15 to about 25 weight percent, the carrier conductivity is from about $10^{-7}$ to about $10^{-8}$ $(\text{ohm-cm})^{-1}$, and the carrier triboelectric charge is from about a positive 5 to about a positive 50 microcoulombs per gram.

23. A process in accordance with claim 14 wherein the carrier core is selected from the group consisting of iron, ferrites, steel and nickel.

24. An improved process for the preparation of carrier particles with an extended triboelectric charging range at relative humidities of from about 20 to about 80 percent, and with an extended conductivity range, which process comprises mixing a carrier core with a polymer mixture, and which mixture comprises a first polymer with carbon black dispersed therein, and a second crosslinked polyurethane polymer, followed by heating until the polymers fused to the core, and thereafter cooling, and wherein said carbon black is present in an amount of from about 18 to about 50 weight percent.

25. A developer comprised of toner and the composition of claim 1.

26. A developer comprised of toner and the composition of claim 2.

27. A developer in accordance with claim 25 with from about 0.1 to about 3.0 percent of the coating polymer mixture by weight and containing said conductive component present in an amount of from about 5 to about 60 weight percent, and which composition possesses a conductivity of from about $1\times10^{-8}$ mho/centimeter to about $1\times10^{-15}$ mho/centimeter, and a triboelectric value of from about a positive 5 to about a positive 50 microcoulombs per gram.

28. A carrier comprised of a core and thereover a mixture of a first and second polymer, and wherein said first polymer contains a conductive component, and said second polymer is a crosslinked poly(urethane)/polyester.

29. A carrier in accordance with claim 28 wherein said polyester is present in an amount of about 20 weight percent.

30. A carrier in accordance with claim 28 wherein said crosslinked polyester polymer possesses a melt temperature of from about 200° F. to about 260° F., and a crosslinking temperature of from about 330° F. to about 420° F.

31. A carrier in accordance with claim 28 wherein the poly(urethane)/polyester has a melt temperature of between 210° F. and 266° F., and a crosslinking temperature of about 345° F.

32. A carrier in accordance with claim 28 wherein the first polymer is present in an amount of from about 1 percent to about 99 percent by weight, and the second polymer is present in an amount of from about 1 to about 99 percent by weight, and wherein the total weight thereof is about equal to a 100 percent.

33. A carrier in accordance with claim 32 wherein the second polymer is present in an amount of from about 5 to about 40 weight percent.

34. A carrier in accordance with claim 28 wherein the first polymer is poly(methylmethacrylate).

35. A carrier in accordance with claim 28 wherein the poly(urethane)/polyester polymer possesses a particle size of between 4 and 7 microns.

36. A developer composition consisting essentially of toner and a carrier comprised of a core, and thereover a mixture of a first and second polymer, and wherein said first polymer contains a conductive component, and said second polymer is a crosslinked poly(urethane).

37. A carrier in accordance with claim 36 wherein the carrier contains therein charge enhancing additives.

* * * * *